US008963908B2

(12) United States Patent
Park

(10) Patent No.: US 8,963,908 B2
(45) Date of Patent: Feb. 24, 2015

(54) LIQUID CRYSTAL DISPLAY DEVICE HAVING A DATA DRIVING CIRCUIT WITH OVERDRIVE CONTROL USING POLARITY CONTROL

(71) Applicant: LG Display Co., Ltd., Seoul (KR)

(72) Inventor: Inrae Park, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 213 days.

(21) Appl. No.: 13/693,544

(22) Filed: Dec. 4, 2012

(65) Prior Publication Data

US 2013/0141414 A1 Jun. 6, 2013

(30) Foreign Application Priority Data

Dec. 5, 2011 (KR) ..... 10-2011-0129036

(51) Int. Cl.
*G09G 3/36* (2006.01)
*G09G 3/00* (2006.01)

(52) U.S. Cl.
CPC ..... *G09G 3/3611* (2013.01); *G09G 3/001* (2013.01); *G09G 3/3614* (2013.01); *G09G 3/3648* (2013.01); *G09G 2310/0218* (2013.01); *G09G 2320/0233* (2013.01); *G09G 2320/0252* (2013.01)
USPC ..... 345/212; 345/96; 345/98; 345/214

(58) Field of Classification Search
CPC . G09G 3/3611; G09G 3/3614; G09G 3/3648; G09G 2320/0252
USPC ..... 345/96–104, 204
See application file for complete search history.

(56) References Cited

U.S. PATENT DOCUMENTS

| | | | | |
|---|---|---|---|---|
| 2004/0032386 | A1* | 2/2004 | Pai | 345/96 |
| 2005/0140635 | A1* | 6/2005 | Kwon | 345/98 |
| 2005/0200587 | A1* | 9/2005 | Hwang | 345/96 |
| 2008/0024473 | A1* | 1/2008 | Hsu et al. | 345/204 |
| 2010/0309192 | A1* | 12/2010 | Chao et al. | 345/214 |

* cited by examiner

*Primary Examiner* — Srilakshmi K Kumar
*Assistant Examiner* — James Nokham
(74) *Attorney, Agent, or Firm* — Brinks Gilson & Lione

(57) ABSTRACT

The liquid crystal display of the present invention lowers the power consumption and heat generation of the data driving circuit by controlling the polarity of a data voltage by divided block-type column inversion to maintain the polarity of the data voltage within one block, and prevents picture quality degradation by inverting the polarity of a data voltage between neighboring blocks.

6 Claims, 5 Drawing Sheets

LIQUID CRYSTAL DISPLAY DEVICE HAVING A DATA DRIVING CIRCUIT WITH OVERDRIVE CONTROL USING POLARITY CONTROL

This application claims the benefit of Korean Patent Application NO. 10-2011-0129036 filed on Dec. 5, 2011, which is incorporated herein by reference for all purposes as if fully set forth herein.

BACKGROUND

1. Field

This document relates to a liquid crystal display and a method for driving the same.

2. Related Art

A liquid crystal display periodically inverts the polarity applied to liquid crystal molecules to reduce direct current afterimages and flicker. Well known in the art such as an inversion driving method includes a variety of methods such as dot inversion shown in FIGS. 1 and 2 and column inversion shown in FIG. 3. In FIGS. 1 through 3, the x-axis is a horizontal direction which is parallel to a gate line (or scan line) of a liquid crystal display panel, and the y-axis is a vertical direction which is parallel to a data line of the liquid crystal display panel. In FIGS. 1 through 3, "FR1" is a first frame period, and "FR2" is a second frame period.

In the dot inversion method as shown in FIG. 1, the polarity of a data voltage charged in liquid crystal cells is inverted every 1 dot in horizontal (x-axis) and vertical (y-axis) directions for each frame period. 1 dot is equal to 1 liquid crystal cell or 1 subpixel, which is the smallest unit for writing a data voltage to the screen. In the dot inversion method as shown in FIG. 2, the polarity of the data voltage charged in the liquid crystal cells is inverted every horizontal 1 dot and every vertical 2 dots. In the dot inversion method, as shown in FIG. 2, the polarity of the data voltage charged in the liquid crystal cells is inverted for each frame period. In the dot inversion method shown in FIGS. 1 and 2, any flicker or difference in luminance is not observed in the horizontal and vertical directions and therefore high picture quality can be achieved. However, the power consumption and heat generation of a data driving circuit are high because the polarity of the data voltage supplied through a data line is inverted many times.

In a column inversion method shown in FIG. 3, the polarity of a data voltage charged in liquid crystal cells is inverted every 1 dot in a horizontal direction but not in a vertical direction. In the column inversion method, as shown in FIG. 3, the polarity of the data voltage charged in the liquid crystal cells is likewise inverted for each frame period. In the column inversion method, the polarity of the data voltage supplied through a data line is not inverted during one frame period. Thus, the power consumption and heat generation of a data driving circuit are low, and this method is relatively excellent in picture quality.

Unless the polarity of a data voltage continuously supplied through the same data line is changed, the amount of data voltage change is small, which shortens the response time of the liquid crystal cells. On the other hand, when the polarity of the data voltage continuously supplied through the same data line is inverted, the amount of data voltage change is large, which lengthens the response time of the liquid crystal cells. Due to this difference in response time, the conventional inversion methods cause a luminance difference between neighboring liquid crystal cells.

SUMMARY

A liquid crystal display comprises: a liquid crystal display panel having a pixel array comprising liquid crystal cells disposed in a matrix form at crossings of data lines and gate lines; a data driving circuit that converts digital video data into a positive/negative gamma compensation voltage to generate a data voltage, supplies the data voltage to the data lines, and inverts the polarity of the data voltage in response to a polarity control signal; a gate driving circuit that sequentially supplies gate pulses to the gate lines; an ODC processor that modulates the digital video data into an over driving modulation value; and a timing controller that controls operation timings of the data driving circuit and the gate driving circuit, supplies the digital video data modulated by the ODC processor to the data driving circuit, and controls the polarity of the data voltage supplied to the liquid crystal display panel by using the polarity control signal.

The pixel array of the liquid crystal display panel is divided into a plurality of blocks, a first polarity data voltage is charged in liquid crystal cells within an Nth (N is a natural number) block, and a second polarity data voltage is charged in liquid crystal cells within an (N+1)th block.

Only the digital video data to be written into liquid crystal cells disposed in the first line of each block is modulated by the ODC processor.

In a liquid crystal display according to another exemplary embodiment of the present invention, digital video data whose data voltage has a constant polarity within each block is modulated into a modulation value set at a first modulation rate by the ODC processor, and digital video data to be written into liquid crystal cells disposed in the first line of each block is modulated, by the ODC processor, into a modulation value set at a second modulation rate, which is greater than the first modulation rate.

The blocks are shifted by a predetermined number of lines for each frame period.

A modulation timing of the digital video data to be written in the liquid crystal cells disposed in the first line of each block is shifted by a predetermined time for each frame period.

In a method for driving a liquid crystal display according to another exemplary embodiment of the present invention, digital video data whose data voltage has a constant polarity within each block is modulated into a modulation value set at a first modulation rate by the ODC processor, and digital video data to be written into liquid crystal cells disposed in the first line of each block is modulated into a modulation value set at a second modulation rate, which is greater than the first modulation rate.

In a method for driving a liquid crystal display according to another exemplary embodiment of the present invention, digital video data whose data voltage has a constant polarity within each block is modulated into a modulation value set at a first modulation rate by the ODC processor, and digital video data to be written into liquid crystal cells disposed in the first line of each block is modulated, by the ODC processor, into a modulation value set at a second modulation rate, which is greater than the first modulation rate.

DETAILED DESCRIPTION OF THE EXEMPLARY EMBODIMENTS

Figure 1:
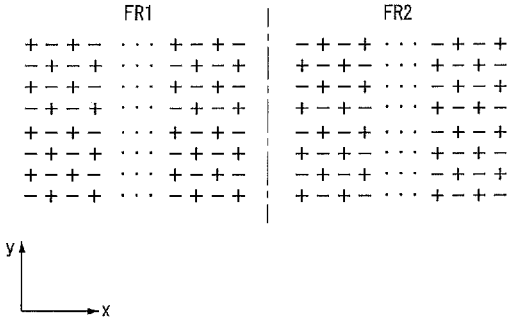
Fig. 1 PRIOR ART
FIGS. 1 and 2 are views showing the polarity of a data voltage in dot inversion.
Figure 2:
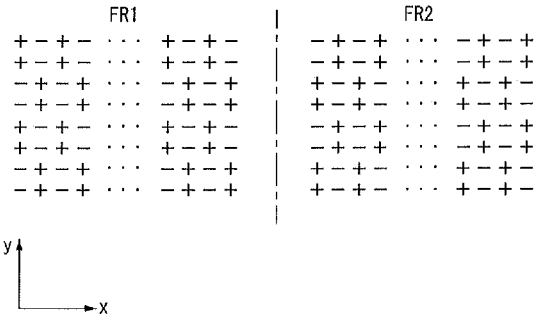
Fig. 2 PRIOR ART
Figure 3:
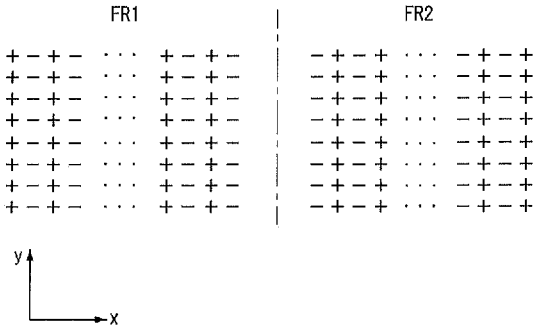
Fig. 3 PRIOR ART
FIG. 3 is a view showing the polarity of a data voltage in column inversion.

Hereinafter, exemplary embodiments of the present invention will be described with reference to the drawings. Throughout the specification, like reference numerals denote substantially like components. In the following description, if it is decided that the detailed description of known function or configuration related to the invention makes the subject matter of the invention unclear, the detailed description is omitted.

As a method for improving the slow response characteristics of a liquid crystal display, over driving control (hereinafter, "ODC") is known. The ODC is disclosed in U.S. Pat. No. 5,495,265. The ODC is a technology for modulating input data into a modulation value preset in a look-up table to reduce the response time of liquid crystal cells. The present invention can reduce a difference in response time between the liquid crystal cells across the entire screen by applying ODC modulation when the polarity of a data voltage is inverted or by increasing the ODC modulation rate.

Figure 4:
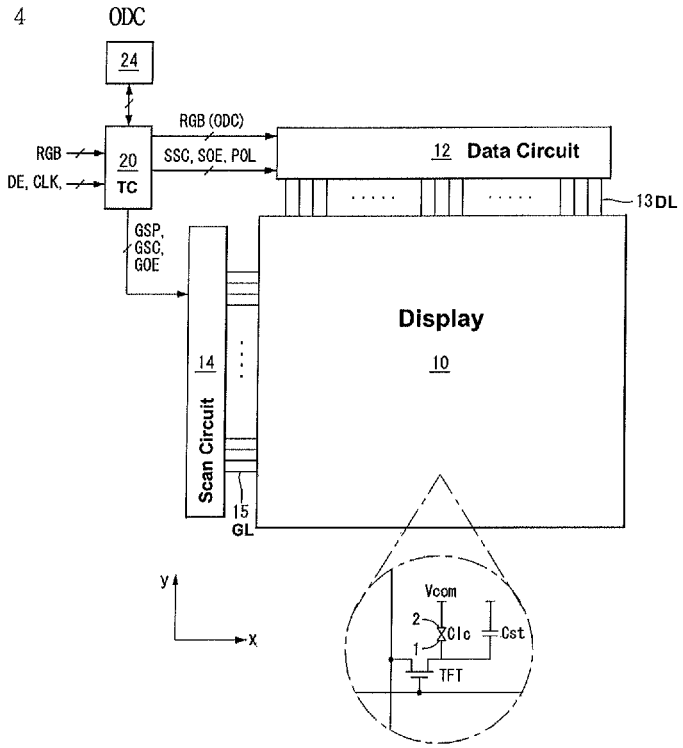
FIG. 4 is a block diagram showing a liquid crystal display according to an exemplary embodiment of the present invention.

Referring to FIG. 4, a liquid crystal display according to an exemplary embodiment of the present invention comprises a liquid crystal display panel 10, a data driving circuit 12, a gate driving circuit 14, a timing controller 20, and an ODC processor 24.

In the liquid crystal display panel 10, a liquid crystal layer is formed between two glass substrates. Liquid crystal cells of the liquid crystal display panel 10 are disposed in a matrix at crossings of data lines 13 and gate lines 14.

Formed on the lower glass substrate of the liquid crystal display panel 10 are data lines 13, gate lines 14, TFTs, liquid crystal cells Clc connected to the TFTs and driven by an electric field between pixel electrodes 1 and a common electrode 2, and storage capacitors Cst. Formed on the upper glass substrate of the liquid crystal display panel 10 are a black matrix, color filters, and the common electrode 2. The common electrode 2 is formed on the upper glass substrate in devices employing a vertical electric field driving method, such as a TN (Twisted Nematic) mode or a VA (Vertical Alignment) mode. Alternatively, the common electrode 2 can be formed along with the pixel electrodes 1 on the lower glass substrate in devices employing a horizontal electric field driving method, such as an IPS (In-Plane Switching) mode or an FFS (Fringe Field Switching) mode. Polarizers on which optical axes are perpendicular to each other are attached on the upper and lower glass substrates of the liquid crystal display panel 10, and alignment films are formed at an interface contacting liquid crystal to set a pre-tilt angle of liquid crystal.

The liquid crystal display panel applicable in the present invention can be implemented as any liquid crystal mode, as well as the above-stated TN mode, VA mode, IPS mode, and FFS mode. Moreover, the liquid crystal display device of the present invention can be implemented in any form including a transmissive liquid crystal display, a semi-transmissive liquid crystal display, and a reflective liquid crystal display. The transmissive liquid crystal display and the semi-transmissive liquid crystal display require a backlight unit, which is omitted in the drawing.

The data driving circuit 12 converts digital video data RGB(ODC) received from the timing controller 10 into a positive or negative gamma compensation voltage. The data driving circuit 12 supplies the positive or negative gamma compensation voltage to the data lines 13 under control of the timing controller 20, and inverts the polarity of the data voltage.

The gate driving circuit 14 generates gate pulses (or scan pulses) under control of the timing controller 20, and sequentially supplies the gate pulses to the gate lines 15.

The timing controller 20 supplies digital video data RGB of an input image to the ODC processor 24, and supplies the data RGB(ODC) modulated by the ODC processor 24 to the data driving circuit 12.

The timing controller 20 generates timing control signals for controlling operation timings of the data driving circuit 12 and the gate driving circuit 14 based on timing signals DE and CLK input from an external host system. The gate timing control signals include a gate start pulse GSP, the gate shift clocks CLK, a gate output enable signal GOE, and so forth. The gate start pulse GSP is applied to a first integrated circuit (IC) of the gate driving circuit 14 to thereby indicate scan start time during which the first gate pulse is generated. The gate shift clock GSC is a clock signal for shifting the gate start pulse GSP. The gate output enable signal GOE controls the output of the gate driving circuit 14. The data timing control signals include a source start pulse SSP, a source sampling clock SSC, a polarity control signal POL, a source output enable signal SOE, and so on. The source sampling clock SSC indicates data sampling and latching operations of the data driving circuit 12 based on a rising or falling edge thereof. The polarity control signal POL controls the polarity of an analog video data voltage output from the data driving circuit 12. The data driving circuit 12 outputs a positive data voltage when the polarity control signal POL has a high logic level voltage, and outputs a negative data voltage when the polarity control signal POL has a low logic level voltage. The source output enable signal SOE controls the output timing of the data driving circuit 12. Also, the timing controller 20 generates a frame inversion signal FRC of FIG. 5 for controlling the ODC processor 24. The frame inversion signal FRC is logically inverted every predetermined period. In the following exemplary embodiment, an inversion period of the frame inversion signal FRC is 1 frame period.

The host system can be implemented as any of the following: a navigation system, a set-top box, a DVD player, a Blue-ray player, a personal computer (PC), a home theater system, a broadcast receiver, and a phone system. The host system comprises a system-on-chip (SoC) having a scaler incorporated therein to convert image data into a data format appropriate to display it on the display panel 10. The host system transmits the timing signals DE and CLK, together with digital video data RGB of an input image, to the timing controller 20.

The ODC processor 24 modulates the digital video data of the input image into an ODC modulation value preset in a look-up table, and supplies it to the timing controller 20. Table 1 below is an example of the ODC modulation value set in the look-up table. It is to be noted that the ODC modulation value is not limited to Table 1 as it can differ depending on panel characteristics and a driving method.

TABLE 1

| 구분 | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 8 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 3 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 14 | 15 | 15 | 15 |
| 9 | 0 | 0 | 1 | 2 | 3 | 4 | 5 | 6 | 7 | 9 | 11 | 12 | 13 | 14 | 15 | 15 |
| 10 | 0 | 0 | 1 | 2 | 3 | 4 | 5 | 6 | 7 | 8 | 10 | 12 | 13 | 14 | 15 | 15 |
| 11 | 0 | 0 | 1 | 2 | 3 | 4 | 5 | 6 | 7 | 8 | 9 | 11 | 13 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

In Table 1, the far left column has data of a previous frame FN−1, and the uppermost row has data of a current frame Fn.

The ODC processor 24 stores digital video data of an input image in a frame memory and delays the data by 1 frame period. The ODC processor 24 inputs, in the look-up table, Nth (N is a natural number) frame data FN currently being input and (N−1)th frame data FN−1 delayed by the frame memory. The look-up table receives the Nth frame data FN and the (N−1)th frame data FN−1 as an input address, and outputs an ODC modulation value stored in the address indicated by the data. The ODC processor 24 supplies, as modulated N-th frame data RGB(ODC), the ODC modulation value to the timing controller 20. The data RGB(ODC) modulated by the ODC processor 24 satisfies Equation 1 below.

$$FN(\mathrm{RGB})<FN-1(\mathrm{RGB})\rightarrow \mathrm{RGB(ODC)}<FN(\mathrm{RGB})$$

$$FN(\mathrm{RGB})=FN-1(\mathrm{RGB})\rightarrow \mathrm{RGB(ODC)}=FN(\mathrm{RGB})$$

$$FN(\mathrm{RGB})>FN-1(\mathrm{RGB})\rightarrow \mathrm{RGB(ODC)}>FN(\mathrm{RGB}) \qquad \text{[Equation 1]}$$

In Equation 1, FN(RGB) indicates digital video data input in an N-th frame period FN, and FN−1 (RGB) indicates digital video data input in an (N−1)th frame period Fn−1 and delayed by the frame memory. An ODC modulation method will be explained on the assumption that the (N−1)th frame data Fn−1 (RGB) and the Nth frame data FN(RGB) are continuously written into the same liquid crystal cell. If the gray level value of the Nth frame data FN(RGB) is greater than that of the (N−1)th frame data FN−1 (RGB), the gray level value of the modulated data RGB(ODC) is greater than the gray level value of the Nth frame data FN(RGB) as shown in Equation 1. If the gray level value of the Nth frame data FN(RGB) is less than that of the (N−1)th frame data FN−1 (RGB), the gray level value of the modulated data RGB (ODC) is less than the gray level value of the Nth frame data FN(RGB) as shown in Equation 1. If the gray level value of the Nth frame data FN(RGB) is equal to that of the (N−1)th frame data FN−1 (RGB), the gray level value of the modulated data RGB(ODC) is equal to the gray level value of the Nth frame data FN(RGB) as shown in Equation 1. The ODC processor 24 can employ the over driving modulation technologies disclosed in Korean Patent Applications Nos. 10-20010032364, 10-2001-0057119, 10-2001-0054123, 10-2001-0054124, 10-2001-0054125, 10-2001-0054127, 10-2001-0054128, 10-2001-0054327, 10-2001-0054889, 10-2001-0056235, 10-2001-0078449, 10-2002-0046858, 10-2002-0075366, 2003-0098100, 2004-00115499, 2004-0049541, 2004-0115730, 2004-0116342, 2004-0116347, and 2006-0116974, which were filed by the applicant of the present invention.

Figure 5:
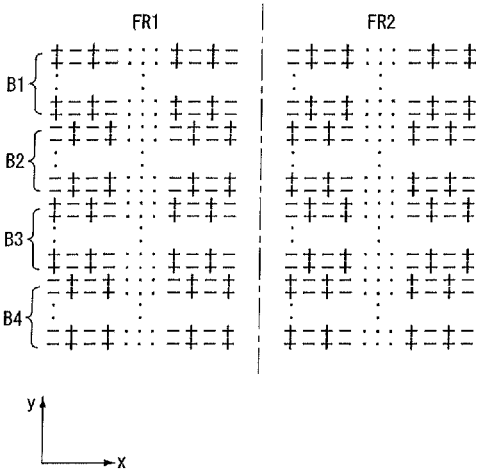
FIGS. 5 and 6 are views showing the polarity of a data voltage in a divided block type column inversion.
Figure 6:
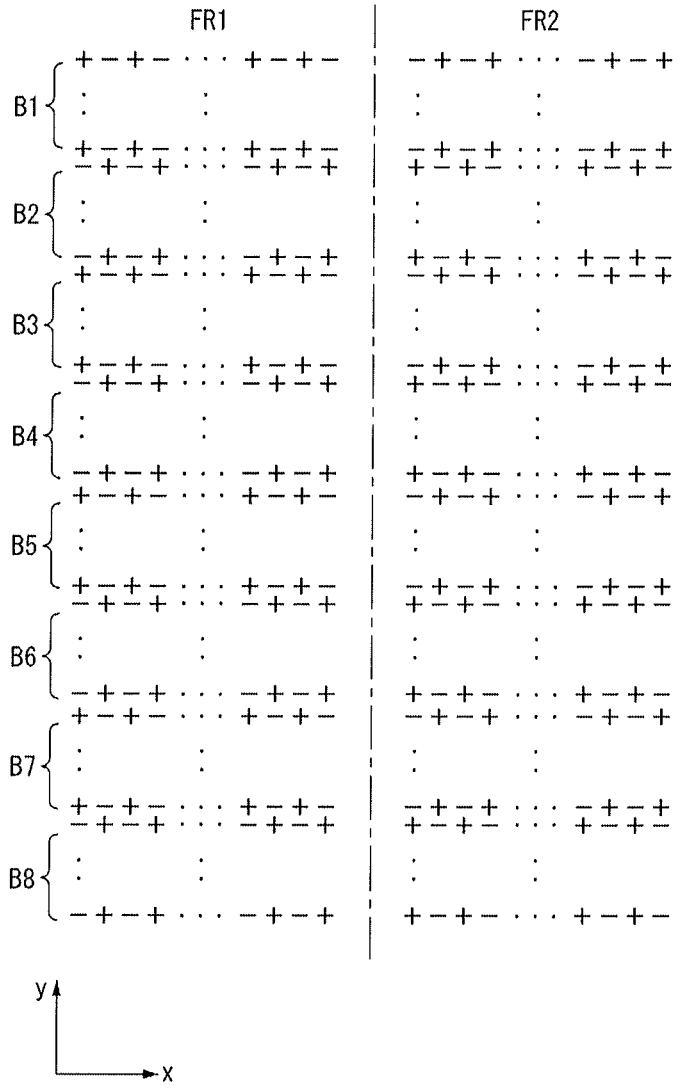

The liquid crystal display of the present invention virtually splits a pixel array of the liquid crystal display panel 10 where input image data is displayed into a plurality of blocks as shown in FIGS. 5 and 6 and drives each of the blocks by column inversion, and reversely controls the polarity of neighboring blocks. If the resolution of the pixel array of the liquid crystal display panel 10 is m×n (m and n are natural numbers), the number of data lines 13 is m and the number of the gate lines 15 is n. In this case, the pixel array of the liquid crystal display panel 10 is split into N blocks (N is a natural number equal to or greater than 2 and equal to or less than n/2).

FIGS. 5 and 6 are views showing the polarity of a data voltage in a divided block-type column inversion. In FIGS. 5 and 6, B1~B8 denote blocks, and FR1 and FR2 denote frame periods.

FIG. 5 shows an example of a pixel array divided into 4 (N=4), and FIG. 6 shows an example of a pixel array divided into 8 (N=8).

In the examples of FIGS. 5 and 6, during a first frame period FR1, a positive data voltage (+) is charged in liquid crystal cells disposed in odd columns of odd blocks B1, B3, B5, and B7, and a negative data voltage (−) is charged in liquid crystal cells disposed in even columns of the odd blocks B1, B3, B5, and B7. During the first frame period FR1, a negative data voltage (−) is charged in liquid crystal cells disposed in odd columns of even blocks B2, B4, B6, and B8, and a positive data voltage (+) is charged in liquid crystal cells disposed in even columns of the even blocks B2, B4, B6, and B8. The liquid crystal cells disposed in the odd columns are connected to odd data lines 13 and supplied with a data voltage through the odd data lines 13. The liquid crystal cells disposed in the even columns are connected to even data lines 13 and supplied with a data voltage through the even data lines 13.

If M (M is a natural number equal to or greater than 2) liquid crystal cells are disposed along a column direction (y-axis direction) within one block, the polarity of a data voltage supplied to the data lines 13 is hold by one of negative polarity and positive polarity during M horizontal periods required to charge the data voltage in all the liquid crystal cells within the one block. Subsequently, the polarity of the data voltage is inverted in an (M+1)th horizontal period during which the data voltage starts to be charged in the liquid crystal cells arranged in the first line (x-axis direction) of the next block.

The voltage of the liquid crystal cells is inverted for each frame period. Accordingly, during a second frame period FR2, a negative data voltage (−) is charged in the liquid crystal cells disposed in the liquid crystal cells disposed in the odd columns of odd blocks B1, B3, B5, and B7, and a positive data voltage (+) is charged in the liquid crystal cells disposed in the even columns of the odd blocks B1, B3, B5, and B7. During the second frame period FR2, a positive data voltage (+) is charged in the liquid crystal cells disposed in the odd columns of the even blocks B2, B4, B6, and B8, and a negative data voltage (−) is charged in the liquid crystal cells disposed in the even columns of the even blocks B2, B4, B6, and B8.

Figure 7:
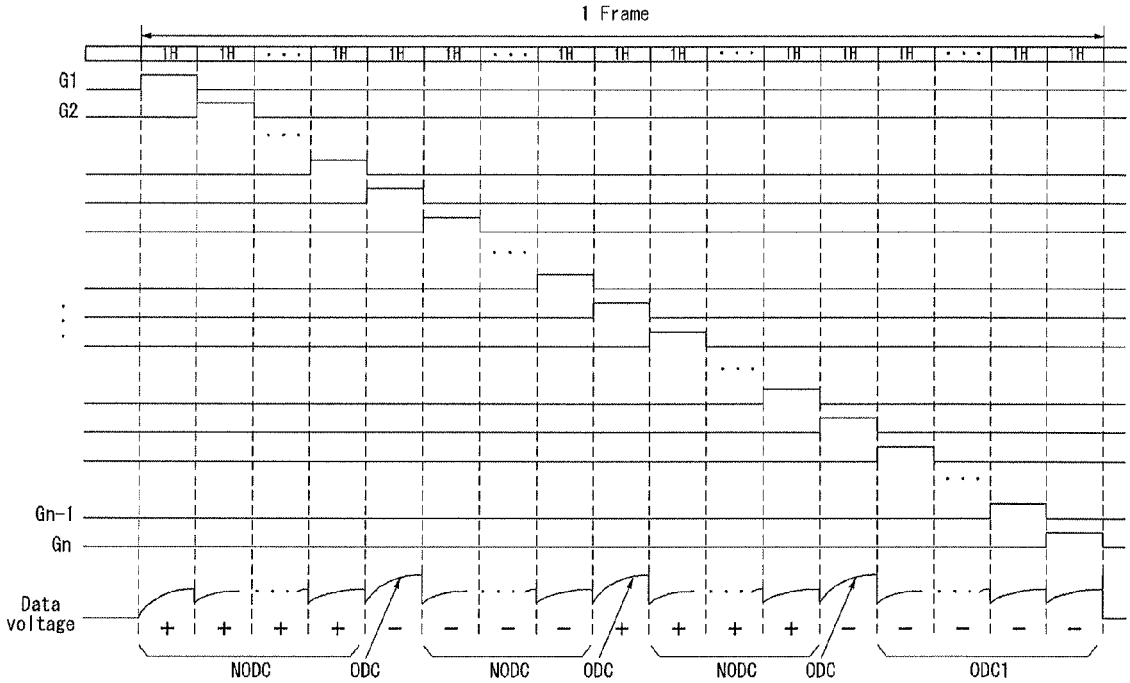
FIG. 7 is a waveform diagram showing an ODC control method according to a first exemplary embodiment of the present invention.
Figure 8:
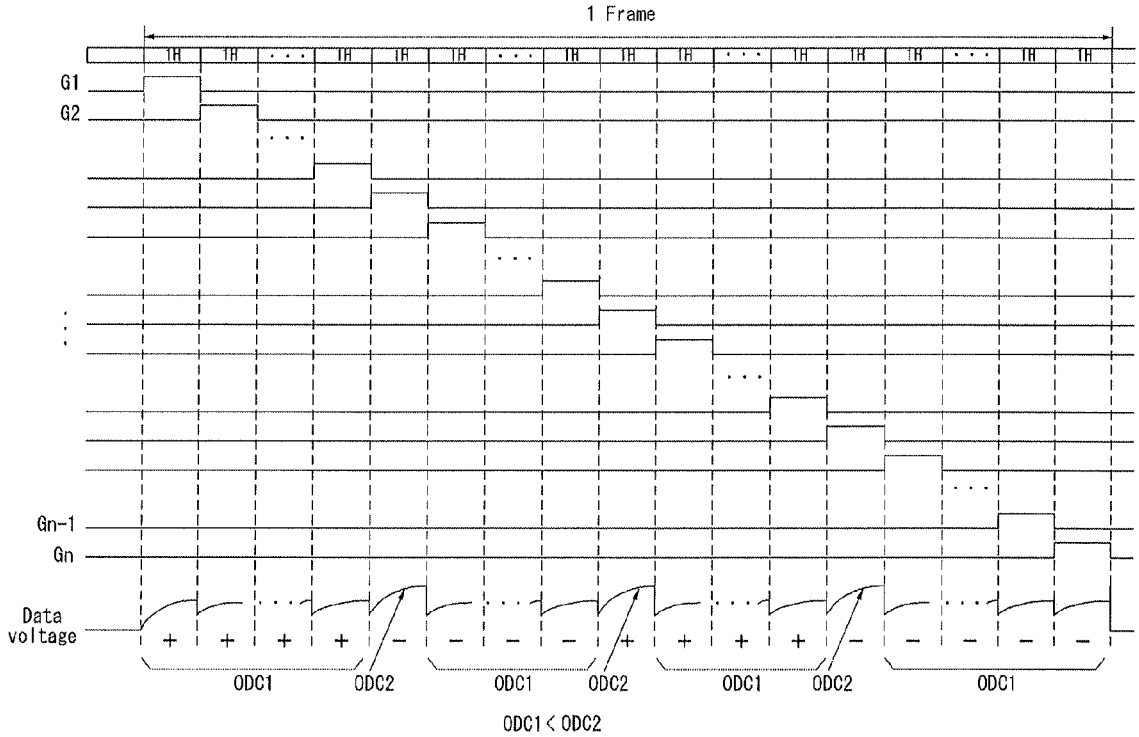
FIG. 8 is a waveform diagram showing an ODC control method according to a second exemplary embodiment of the present invention.

The liquid crystal display of the present invention lowers the power consumption and heat generation of the data driving circuit 12 by controlling the polarity of a data voltage by divided block-type column inversion to maintain the polarity of the data voltage within one block, and prevents picture quality degradation by inverting the polarity of a data voltage between neighboring blocks. In the divided block-type column inversion as shown in FIGS. 5 and 6, the liquid crystal display of the present invention performs ODC modulation only when the polarity of a data voltage is inverted as shown in FIG. 7, or increases the ODC modulation rate as shown in FIG. 8, thereby compensating for the response time of the liquid crystal cells whose polarity is inverted to the same level as the liquid crystal cells whose polarity is hold. As a result, the liquid crystal display of the present invention makes it possible to maintain the response time of all the liquid crystal cells within the pixel array at the same level by employing divided block-type column inversion, thereby increasing luminance uniformity across the entire display screen.

FIG. 7 is a waveform diagram showing an ODC control method according to a first exemplary embodiment of the present invention. In FIG. 7, NODC denotes a data voltage which is not ODC-modulated. 1H denotes 1 horizontal period, and G1~Gn denote the gate lines 15.

Referring to FIG. 4 and FIG. 7, the timing controller 20 transmits digital video data RGB of an input image to the data driving circuit 12 while the polarity of a data voltage is maintained within each block. The data driving circuit 12 receives non-ODC-modulated digital video data RGB while the polarity of the data voltage is maintained within each block. Accordingly, the data driving circuit 12 outputs the non-ODC-modulated data voltage to the data lines 13 while the polarity of the data voltage is maintained within each block.

On the other hand, upon receiving digital video data RGB to be written into the liquid crystal cells disposed in the first line of each block, the timing controller 20 transmits the data RGB to the ODC processor 24. The ODC processor 24 modulates the digital video data RGB input from the timing controller 20 into an ODC modulation value, and transmits it to the timing controller 20. The timing controller 20 transmits data RGB(ODC) modulated by the ODC processor 24 to the data driving circuit 12. The data driving circuit 12 receives, as the modulated data RGB(ODC), the digital video data RGB to be written into the liquid crystal cells disposed in the first line of each block. Accordingly, the data driving circuit 12 outputs an ODC-modulated data voltage as a data voltage to be written into the liquid crystal cells disposed in the first line of each block.

FIG. 8 is a waveform diagram showing an ODC control method according to a second exemplary embodiment of the present invention. In FIG. 8, ODC1 denotes a data voltage which is ODC-modulated at a first ODC modulation rate, and ODC2 denotes a data voltage which is ODC-modulated at a second ODC modulation rate. The first and second ODC modulation rates satisfy Equation 1, and the second ODC modulation rate is set higher than the first ODC modulation rate. An example is given assuming that the gray level value of data to be continuously written into the same liquid crystal cell increases from "100" to "120". If the gray level value of data is "100" in the (N−1)th frame period Fn−1 and increases to "120" in the Nth frame period FN, the gray level value of the data RGB(ODC) modulated at the first ODC modulation rate, can be "122". On the other hand, the gray level value of the data RGB(ODC) modulated at the second ODC modulation rate can be "124" under the same condition as above. To implement the exemplary embodiment of FIG. 8, an ODC look-up table comprises a first look-up table with ODC modulation values set therein at the first ODC modulation rate and a second look-up table with ODC modulation values set therein at the second ODC modulation rate.

Referring to FIG. 4 and FIG. 8, the timing controller 20 transmits digital video data RGB of an input image to the ODC processor 24 while the polarity of a data voltage is maintained within each block. The ODC processor 24 inputs the digital video data RGB input from the timing controller 20 in the first look-up table while the polarity of the data voltage is maintained within each block, and modulates the data into a modulation value at a first ODC modulation rate. The timing controller 20 transmits data RGB(ODC) modulated by the ODC processor 24 to the data driving circuit 12. The data driving circuit 12 receives the data RGB(ODC) modulated at the first ODC modulation rate while the polarity of the data voltage within each block is maintained. Accordingly, the data driving circuit outputs a data voltage modulated at the first ODC modulation rate to the data lines 13 while the polarity of the data voltage within each block is maintained.

Upon receiving digital video data RGB to be written into the liquid crystal cells disposed in the first line of each block, the timing controller transmits the data RGB to the ODC processor 24. Upon receiving the digital video data RGB to be written into the liquid crystal cells disposed in the first line of each block, the ODC processor 24 inputs the digital video data RGB input from the timing controller 20 in the second look-up table and modulates the data into a modulation value at the second ODC modulation rate. The timing controller 20 transmits data RGB(ODC) modulated by the ODC processor 24 to the data driving circuit 12. When the digital video data RGB to be written into the liquid crystal cells disposed in the first line of each block is input, the data driving circuit 12 receives the data RGB(ODC) modulated at the second ODC modulation rate. Accordingly, upon receiving the digital video data RGB to be written into the liquid crystal cells disposed in the first line of each block, the data driving circuit 12 outputs a data voltage modulated at the second ODC modulation rate to the data lines 13.

Meanwhile, the timing controller 20 is able to count data enable signals DE and determine which line of the liquid crystal display panel 10 data current being input is to be displayed in. Accordingly, the timing controller 20 can identify data to be ODC-modulated in FIG. 7 or data to be modulated at the second ODC modulation rate, according to the count of data enable signals DE.

Figure 9:
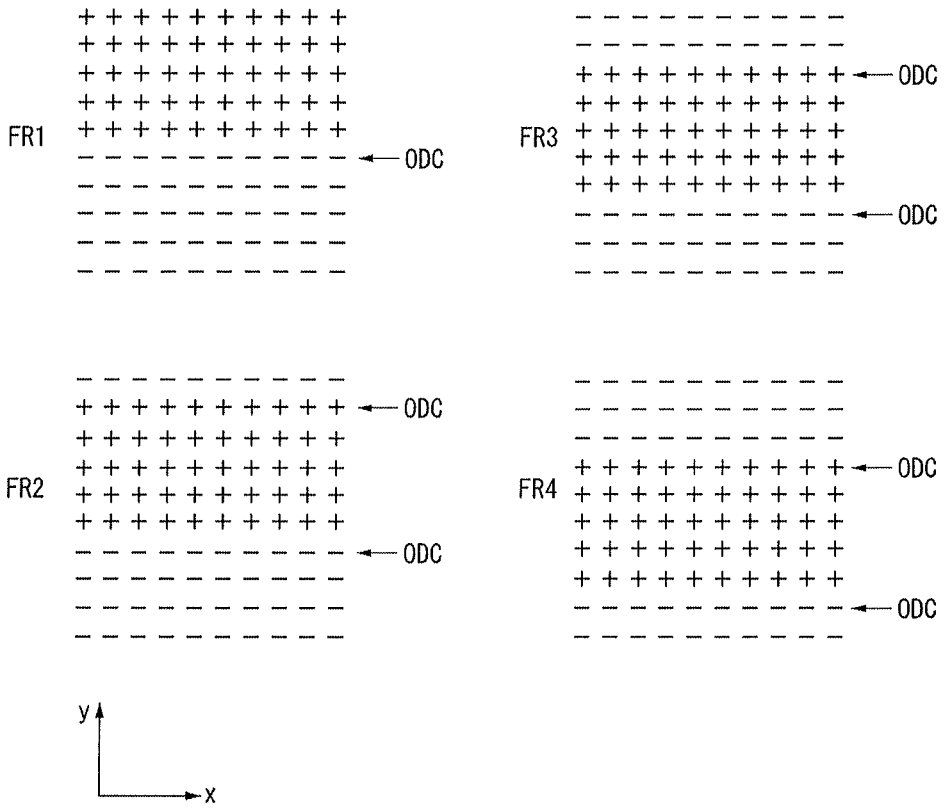
FIG. 9 shows a waveform diagram applied to an ODC control method, in case that a polarity of split block type column inversion is shifted.

In the divided block-type column inversion, the blocks can be shifted by N lines for each frame period. For example, the blocks can be shifted down by 1 line, as shown in FIG. 9, or by a predetermined number of lines ranging between 2 and 10, for each frame period. In this case, the timing for inputting the digital video data RGB to be written into the liquid crystal cells disposed in the first line of each block is shifted by N horizontal periods for each frame period. Accordingly, in the divided block-type column inversion as shown in FIG. 9, the timing controller shifts the timing of ODC modulation of FIG. 7 and the timing of modulation at the second ODC modulation rate of FIG. 8 by N horizontal periods for each frame period.

Throughout the description, it should be understood for those skilled in the art that various changes and modifications are possible without departing from the technical principles of the present invention. Therefore, the technical scope of the present invention is not limited to those detailed descriptions in this document but should be defined by the scope of the appended claims.

What is claimed is:

1. A liquid crystal display comprising:

a liquid crystal display panel having a pixel array comprising liquid crystal cells disposed in a matrix form at crossings of data lines and gate lines;

a data driving circuit that converts digital video data into a positive/negative gamma compensation voltage to generate a data voltage, supplies the data voltage to the data lines, and inverts the polarity of the data voltage in response to a polarity control signal;

a gate driving circuit that sequentially supplies gate pulses to the gate lines; an ODC processor that modulates the digital video data into an over driving modulation value; and a timing controller that controls operation timings of the data driving circuit and the gate driving circuit, supplies the digital video data modulated by the ODC processor to the data driving circuit, and controls the polarity of the data voltage supplied to the liquid crystal display panel by using the polarity control signal, wherein the pixel array of the liquid crystal display panel is divided into a plurality of blocks, a first polarity data voltage is charged in liquid crystal cells within an Nth (N is a natural number) block, and a second polarity data voltage is charged in liquid crystal cells within an (N+1) th block, and only the digital video data to be written into liquid crystal cells disposed in the first line of each block is modulated by the ODC processor.

2. A liquid crystal display comprising:

a liquid crystal display panel having a pixel array comprising liquid crystal cells disposed in a matrix form at crossings of data lines and gate lines;

a data driving circuit that converts digital video data into a positive/negative gamma compensation voltage to generate a data voltage, supplies the data voltage to the data lines, and inverts the polarity of the data voltage in response to a polarity control signal;

a gate driving circuit that sequentially supplies gate pulses to the gate lines; an ODC processor that modulates the digital video data into an over driving modulation value; and a timing controller that controls operation timings of the data driving circuit and the gate driving circuit, supplies the digital video data modulated by the ODC processor to the data driving circuit, and controls the polarity of the data voltage supplied to the liquid crystal display panel by using the polarity control signal, wherein the pixel array of the liquid crystal display panel is divided into a plurality of blocks, a first polarity data voltage is charged in liquid crystal cells within an Nth (N is a natural number) block, and a second polarity data voltage is charged in liquid crystal cells within an (N+1) th block, digital video data whose data voltage has a constant polarity within each block is modulated into a modulation value set at a first modulation rate by the ODC processor, and digital video data to be written into liquid crystal cells disposed in the first line of each block is modulated, by the ODC processor, into a modulation value set at a second modulation rate, which is greater than the first modulation rate.

3. The liquid crystal display of claim 1, wherein the blocks are shifted by a predetermined number of lines for each frame period.

4. The liquid crystal display of claim 1, wherein a modulation timing of the digital video data to be written in the liquid crystal cells disposed in the first line of each block is shifted by a predetermined time for each frame period.

5. A method for driving a liquid crystal display having a pixel array comprising liquid crystal cells disposed in a matrix form at crossings of data lines and gate lines, the method comprising:

generating a polarity control signal for controlling the polarity of a data voltage supplied to the liquid crystal cells;

converting digital video data into a positive/negative gamma compensation voltage to generate a data voltage, supplying the data voltage to the data lines, and inverting the polarity of the data voltage in response to a polarity control signal;

sequentially supplying gate pulses to the gate lines; and modulating the digital video data into an over driving modulation value, wherein the pixel array of the liquid crystal display panel is divided into a plurality of blocks, a first polarity data voltage is charged in liquid crystal cells within an Nth (N is a natural number) block, and a second polarity data voltage is charged in liquid crystal cells within an (N+1) th block, and only the digital video data to be written into liquid crystal cells disposed in the first line of each block is modulated by the ODC processor.

6. A method for driving a liquid crystal display having a pixel array comprising liquid crystal cells disposed in a matrix form at crossings of data lines and gate lines, the method comprising:

generating a polarity control signal for controlling the polarity of a data voltage supplied to the liquid crystal cells;

converting digital video data into a positive/negative gamma compensation voltage to generate a data voltage, supplying the data voltage to the data lines, and inverting the polarity of the data voltage in response to a polarity control signal;

sequentially supplying gate pulses to the gate lines; and modulating the digital video data into an over driving modulation value, wherein the pixel array of the liquid crystal display panel is divided into a plurality of blocks, a first polarity data voltage is charged in liquid crystal cells within an Nth (N is a natural number) block, and a second polarity data voltage is charged in liquid crystal cells within an (N+1) th block, digital video data whose data voltage has a constant polarity within each block is modulated into a modulation value set at a first modulation rate by the ODC processor, and digital video data to be written into liquid crystal cells disposed in the first line of each block is modulated, by the ODC processor, into a modulation value set at a second modulation rate, which is greater than the first modulation rate.

* * * * *